United States Patent [19]

Nylen

[11] 4,051,761

[45] Oct. 4, 1977

[54] METHOD FOR ADJUSTING THE TONE CHARACTERISTIC OF TONE GENERATING ELEMENTS AND A DEVICE THEREFOR

[76] Inventor: Artur Nylen, 6888 Ward Ave., Charleston Heights, S.C. 29405

[21] Appl. No.: 583,441

[22] Filed: June 3, 1975

[30] Foreign Application Priority Data

June 11, 1974 Sweden ..... 7407717

[51] Int. Cl.[2] ..... G10H 3/00

[52] U.S. Cl. ..... 84/1.15; 84/1.16

[58] Field of Search ..... 84/1.09, 1.1, 1.15, 84/1.16, 1.27; 179/1 M

[56] References Cited

U.S. PATENT DOCUMENTS

| | | | |
|---|---|---|---|
| 2,064,985 | 12/1960 | Webster | 84/1.15 |
| 3,018,680 | 1/1962 | Paul | 84/1.15 |
| 3,525,797 | 8/1970 | Pavia | 84/1.15 |

*Primary Examiner*—E. S. Jackmon

*Attorney, Agent, or Firm*—Ulle C. Linton

[57] ABSTRACT

A method and device for tuning each tone generating element of a musical instrument having solenoids electrically connected to an amplifier and a manually moveable magnet capable of being moved along each tone generating element individually to and from said solenoids.

5 Claims, 3 Drawing Figures

METHOD FOR ADJUSTING THE TONE CHARACTERISTIC OF TONE GENERATING ELEMENTS AND A DEVICE THEREFOR

This invention refers to a method for adjusting the tone characteristic of tone generating elements for musical instruments. More specifically the invention is concerned with tone generating elements which at least partly consist of a magnetisable material such as strings for violins and guitars. Although the best results are obtained with steel strings the invention is also applicable upon strings having a magnetisable core and a cover of for instance polyamide or a magnetisable tablet secured to for instance a nylon string.

It is well known to amplify the sound from instruments by means of pick-up devices connected to an amplifier. Such pick-up microphones give in many cases a satisfactory result but in connection with musical instruments such as violins, guitars and similar instruments where the tone characteristic is of extreme importance such known devices have failed to give satisfactory reproductions.

One object of the invention is thus to obtain a method and a device which makes it possible to amplify the sound from a musical instrument without negative influence of the tone characteristic.

Another object of the invention is to tune a number of tone generating elements relative to each other to obtain a balance between the tone generating elements of a musical instrument.

Still another object of the invention is to provide an echo effect.

With these and other objects of the invention in mind the invention will now be described in connection with the accompanying drawing in which an exemplary embodiment of the invention is illustrated.

In the drawing

Figure 1:
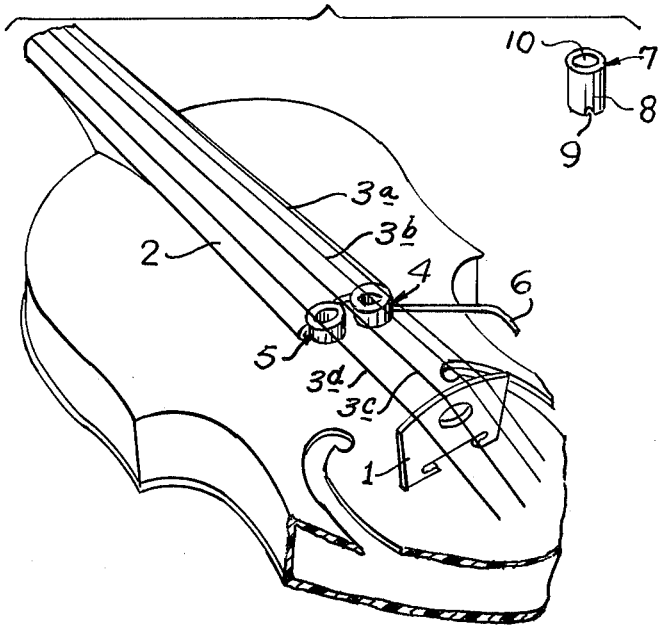
FIG. 1 is a perspective view of a part of a violin being provided with the device according to this invention.

In the drawing reference numeral 1 designates the bridge of a violin. The neck is designated 2 and the strings are designated *3a, 3b, 3c* and *3d*. Reference numerals 4 and 5 designate two solenoids without core. Said solenoids are connected in series or parallel and are further connected to an amplifier of conventional design via a lead 6. Numeral 7 designates a magnetizing device which in the illustrated embodiment comprises a sleeve 8 made from a magnetically insulating material such as a plastic resin. In one of its ends said sleeve has a recess 9 which is dimensioned to fit over a string of the instrument. A magnet 10 is pressed into or otherwise secured to the sleeve such that its poles are at a predetermined distance from said recess.

In order to obtain an increased loudness in the reproduction the magnetizing device is moved along one string in a direction towards the center of the solenoid 4 respectively 5 located under said string. It is obvious that the recess 9 serves to correctly guide the magnetizing device in this movement. When the magnetizing device is moved in this direction the sound from the string will successively raise its volume and reach a maximum when the magnetizing device has reached the center of the solenoid. It is obvious that the strings may be balanced relative to each other when the magnetizing is stopped at different positions for the different strings. It is to be noted that the solenoid has no core at all. A string which has not been magnetized as described is completely dead in the electronic reproduction which means that one or several strings may be discoupled simply by demagnetizing said strings. It is of importance that the tone characteristic is permanent after the magnetizing operation but at any time the characteristic may be changed by carrying out a new magnetizing operation. In addition to the surprising effect that the loudness of the sound of each string may be accurately set, a still more surprising effect is that the quality of the sound is much better than with pick-up microphones using solenoids with cores of magnetisable material. It may be noted that one single solenoid may cover two or more strings.

It is obvious that the method and device is very simple and cheap to realise. The resistance of the solenoids may vary within wide limits such as 2–5,000. The best results have however been obtained with solenoids having a resistance in the range of 20–25.000.

As the principles for solenoids and amplifiers is well known no description of these elements are included in this description.

Figure 3:
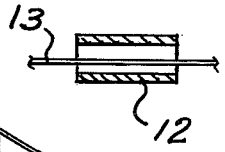
FIG. 3 is a longitudinal section of a modification.
Figure 2:
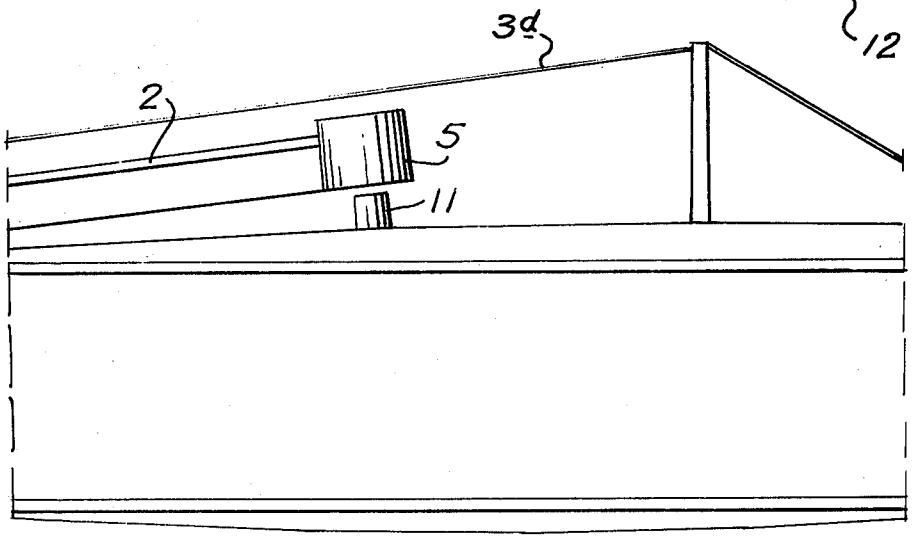
FIG. 2 is a side view of the device illustrated in FIG. 1.

If a magnet 11 is located at a distance from the solenoids an echo effect is obtained. As appears from FIG. 3 the invention may also be applicated to strings made from a non-magnetisable material such as nylon. To obtain the same effect as described above it is only necessary to provide a small tablet or sleeve made from a magnetisable of magnetic material. If the tablet 12 is made from a magnetic material it is only necessary to slide said tablet along the string 13 and lock it in the position in which the reproduction is found best.

I claim:

1. A method for adjusting the tone characteristics of tone generating elements such as strings of musical instruments including a bridge for said strings, said tone generating elements at least being partly of a magnetizable material, comprising the steps of permanently arranging a solenoid near to, but out of contact with said elements and separate from the bridge, electrically connecting said solenoid to an amplifier and moving a magnet along each of said tone generating elements separately towards and away from the part thereof which faces the center of said solenoid and dimishing respectively the loudness of the reproduction and altering the tone characteristics thereof.

2. A method as claimed in claim 1 including arranging a magnet at a distance from said tone generating element and said solenoid for obtaining an echo effect in the reproduction.

3. A device for adjusting the tone characteristics of tone generating elements comprising tone generating elements which at least are partly made of a magnetizable material, a solenoid being located near to, but out of contact with said tone generating elements, an amplifier electrically connected to said solenoid and a manually operable magnet capable of being moved along each of said tone generating elements individually towards and away from the part thereof facing the center of said solenoid to increase and diminish respectively the loudness of the reproduction and alter the tone characteristics thereof.

4. A device as claimed in claim 3 wherein at least two solenoids are electrically connected to each other and to said amplifier, at least one string of a musical instrument is provided to act upon each of said solenoids.

5. A device as claimed in claim 3, wherein at least one magnet is provided at a distance from said tone generating element and the solenoid cooperating therewith.

* * * * *